US005697304A

United States Patent [19]

Noris

[11] Patent Number: 5,697,304

[45] Date of Patent: Dec. 16, 1997

[54] CRUCIFORM DISPLAY

[76] Inventor: Buford A. Noris, 15350 Peachmeadow La., Channelview, Tex. 77530

[21] Appl. No.: 678,703

[22] Filed: Jul. 11, 1996

[51] Int. Cl.[6] ..... A47B 13/02

[52] U.S. Cl. ..... 108/150; 108/91; 403/231; 211/194

[58] Field of Search ..... 108/91, 150; 211/194, 211/196, 205, 88; 403/231, 292; 249/165

[56] References Cited

U.S. PATENT DOCUMENTS

| | | | |
|---|---|---|---|
| D. 232,541 | 8/1974 | Bartley et al. . | |
| D. 330,129 | 10/1992 | Kelly . | |
| 464,494 | 12/1891 | Cline | 211/194 |
| 2,506,844 | 5/1950 | Smith | 211/188 |
| 3,545,712 | 12/1970 | Ellis | 403/231 X |
| 3,856,147 | 12/1974 | Piretti | 211/188 |
| 4,094,255 | 6/1978 | Zaccaria | 108/150 X |
| 4,242,971 | 1/1981 | Kleinman | 108/150 X |
| 4,262,605 | 4/1981 | Sokol . | |
| 4,423,913 | 1/1984 | Lee | 211/194 X |
| 4,709,640 | 12/1987 | Jouanin | 108/91 |
| 5,038,942 | 8/1991 | Wright | 211/194 X |
| 5,492,399 | 2/1996 | Tillack | 108/91 X |

FOREIGN PATENT DOCUMENTS

| | | |
|---|---|---|
| 531357 | 11/1957 | Belgium . |
| 2608700 | 9/1977 | German Dem. Rep. . |
| 602048 | 7/1978 | Switzerland . |
| 633050 | 12/1949 | United Kingdom . |

*Primary Examiner*—Jose V. Chen
*Attorney, Agent, or Firm*—Stephen R. Greiner

[57] ABSTRACT

A cabinet or display in the form generally resembling that of a Latin cross. The display is assembled from a number of separable, shelving units each having a box-like configuration. A first shelving unit, having a pair of shelves, forms the upright of the cross. A second shelving unit is horizontally positioned atop the first shelving unit so as to form the arms of the cross. A third shelving unit is centrally positioned atop the second shelving unit to form the head of the cross. The bottom of the first shelving unit is preferably located on a pedestal having upwardly extending gussets for supporting the sides of the first shelving unit.

3 Claims, 1 Drawing Sheet

CRUCIFORM DISPLAY

FIELD OF THE INVENTION

The present invention relates generally to cabinet structures including a number of stacked or terraced units.

BACKGROUND OF THE INVENTION

In the past, cabinets have been constructed from individual units superposed, one atop the other, to form a completed structure. For stability, a relatively large base unit was typically placed upon the floor, or other horizontal support surface, and successively smaller units were stacked upon it. While such a construction method yields a stable cabinet structure, it also yields one with a large footprint which is often difficult to position within a modern retail or residential space. A need, therefore, exists for a cabinet capable of holding a large quantity of goods yet having a small footprint.

SUMMARY OF THE INVENTION

In light of the problems associated with the known cabinet structures, it is a principal object of the invention to provide a cabinet or display with a cross-shaped configuration having a small footprint yet being capable of holding a large number of items in a stable manner. Some of these items may be retained in the outstretched "arms" of the display and suspended laterally of its footprint.

Many Christians have come to recognize the cross as a symbol of their religious faith. A display constructed in accordance with this invention could, of course, be utilized to support religious items. During the Christmas celebration, for example, the display could be substituted for the usual Christmas tree as a prop for decorative lights, ornaments and gifts. Thus, for some, the display could aid in focusing their thoughts on the birth and death of Jesus. After the Christmas celebration, the display may be readily disassembled for storage or retained in a fully assembled condition for continuous use throughout the year.

It is an object of the invention to provide improved elements and arrangements thereof in a cabinet or display for the purposes described which is lightweight, inexpensive, dependable and fully effective in accomplishing its intended purposes.

Briefly, the cruciform display in accordance with this invention achieves the intended objects by featuring a first, vertically oriented, shelving unit having a first pair of opposed side walls secured together by a first bottom wall. A second, horizontally oriented, shelving unit, having a second pair of opposed side walls more widely spaced than the first pair of opposed side walls, is centrally positioned atop the first shelving unit. A third, vertically oriented, shelving unit is centrally positioned atop the second shelving unit. A pedestal is positioned beneath the first bottom wall for supporting the first pair of opposed side walls in an upright orientation.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
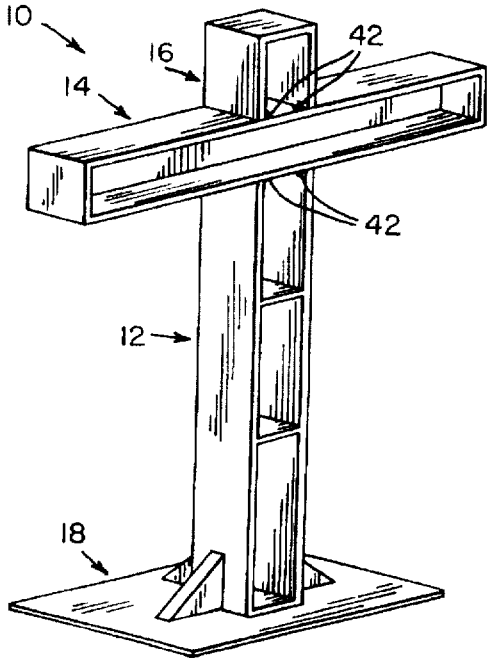
FIG. 1 is a perspective view of a cruciform display in accordance with the present invention.
Figure 2:
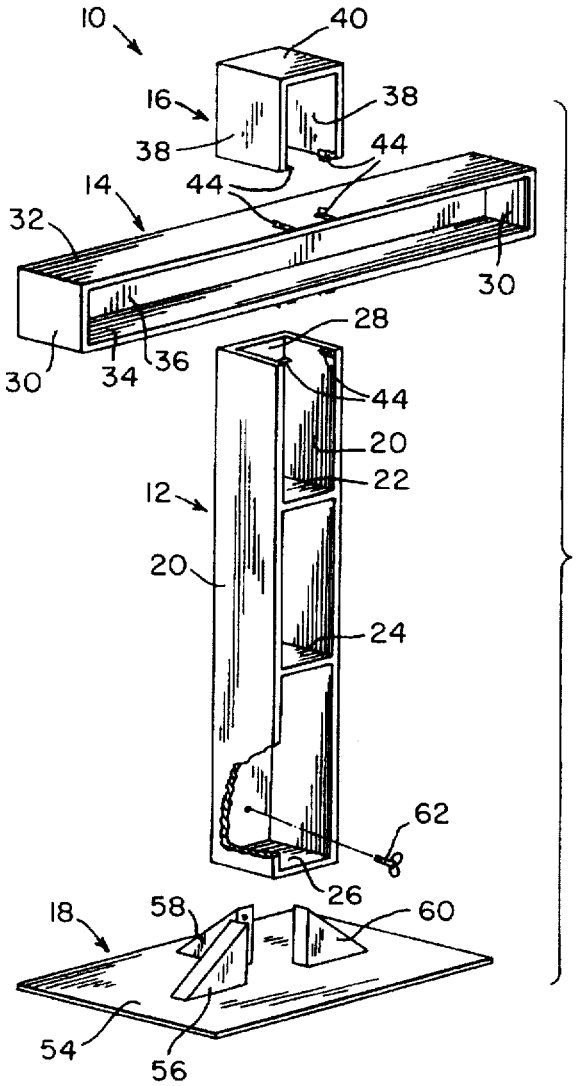
FIG. 2 is an exploded perspective view of the cruciform display of FIG. 1 having a portion broken away to reveal details thereof.

Referring now to FIGS., a cruciform display in accordance with the present invention is illustrated at 10. As shown, the display 10 has a preferred shape resembling that of a Latin cross and is assembled from three separable, shelving units 12, 14 and 16 each having a generally rectangular, box-like configuration. For additional lateral support during use, the lowermost shelving unit 12 may be secured to a load-distributing pedestal 18.

The lowermost shelving unit 12 forms the upright portion of the Latin cross. The shelving unit 12 comprises a pair of elongated side walls 20 joined together by spaced-apart shelves 22 and 24 as well as bottom wall 26. The rear of the shelving unit 12 is closed by a back wall 28 secured to the side and bottom walls 20 and 26 whereas the top of the shelving unit 12 preferably remains open.

The medial shelving unit 14 is positioned atop the shelving unit 12 so as to form the outstretched arm portion of the cross. As shown, the shelving unit 14 includes a pair of opposed side walls 30 (dimensioned substantially the same as that of bottom wall 26) connected together by elongated top and bottom walls 32 and 34 respectively. The shelving unit 14 is closed by a back wall 36 secured about its periphery to side walls 30, top wall 32 and bottom wall 36.

The uppermost shelving unit 16 is centrally positioned on the top wall 32 of the medial shelving unit 14. Preferably, the shelving unit 16 has a pair of side walls 38 secured together by a top wall 40 and a back wall (not shown). The front and bottom of the shelving unit 16 remain open.

The shelving units 12, 14 and 16 may be formed from any suitable material. When, for instance, the shelving units 12 and 14 are provided with a length on the order of several feet as they are in the preferred embodiment of the display 10, plywood sheeting has been found to be an ideal construction material and conventional cabinetry techniques may be employed to assemble the shelving units. On the other hand, smaller displays 10 may be constructed from shelving units 12, 14 and 16 molded or otherwise assembled from thermoplastic materials.

Figure 3:
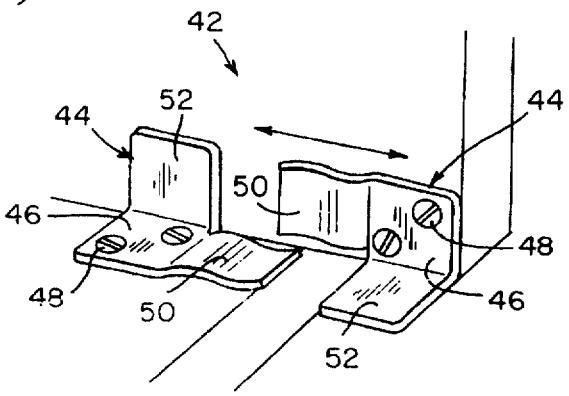
FIG. 3 is an enlarged perspective view of a self-locking fitting for use in assembling the cruciform display.

Similarly, any convenient means may be employed to fasten the shelving units 12, 14 and 16 together. One particularly effective fastening means includes four self-locking couplings 42 one of which is illustrated in detail in FIG. 3.

As shown, the coupling 42 comprises a pair of interconnecting brackets 44 preferably formed from sheet metal. Each bracket 44 includes a base 46 of square outline which has been bored for the passage of mounting screws 48. Extending laterally from one side of the base 46 is a compression arm 50 having a shallow S-shaped form when viewed in cross section. A fin 52 extends from the adjacent side of the base 46 in a plane disposed ninety degrees from the one transecting both the base 46 and compression arm 52.

In joining one shelving unit to another, the fin 52 of a first bracket 44 slides or fits snugly beneath a correspondingly positioned compression arm 50 of a second bracket 44. Similarly, the fin of the second bracket fits snugly beneath the compression arm of the first bracket. Of course, disconnecting the shelving units from one another is accomplished by simply sliding the fins from beneath the compression arms.

The pedestal 18 supports the shelving unit 12 and helps retain it in an upright position despite uneven loading. The pedestal 18 includes a thin sheet 54 of plywood or like material for placement on a supporting surface and, perhaps, unobtrusively beneath adjacent articles of furniture. As shown, the sheet 54 is preferably rectangular in shape and has a surface area at least nine times that of the bottom wall 26 of the shelving unit 12. Three gussets 56, 58, 60 are secured to the top of the sheet 54 and are spaced to snugly engage and support the side walls 20 and back wall 28 of the shelving unit 12. If desired, a wing nut 62 may be employed to affix the back wall 28 to its associated gusset 58.

The preferred display 10 stands eighty inches tall and is fifty-six inches wide. It may, of course, be used to support numerous items of the user's choice. After use, the display 10 may be readily disassembled and stored.

While the display 10 has been described with a high degree of particularity, it will be appreciated by those skilled in the art that numerous modifications and substitutions may be made thereto. For example, the number and location of the self-locking couplings 42 may be changed to suit the needs of a particular user. Therefore, it is to be understood that the present invention is not limited to the sole embodiment described above, but encompasses any and all embodiments within the scope of the following claims.

I claim:

1. A display, comprising:

a first shelving unit having a first pair of opposed side walls secured together by a first bottom wall and at least one shelf spaced from said first bottom wall, said shelf also being spaced from the respective tops of said first pair of opposed side walls;

a second shelving unit having a second pair of opposed side walls, said second pair of opposed side walls being more widely spaced from one another than said first pair of opposed side walls, said second pair of opposed side walls being oriented in planes positioned substantially parallel to said first pair of opposed side walls, said second pair of opposed side walls being secured together by a top wall and a second bottom wall, and said second bottom wall being centrally secured atop said first pair of opposed side walls;

a third shelving unit having a third pair of opposed side walls secured together by a second top wall, said third pair of opposed side walls being centrally positioned atop said second top wall and oriented substantially in the same planes as said first pair of opposed side walls whereby said first, second and third shelving units form a cruciform configuration; and, a plurality of self-locking couplings for securing said first pair of opposed side walls to said second bottom wall and said third pair of opposed side walls to said second top wall, each of said self-locking couplings including a pair of interconnecting brackets, each of said interconnecting brackets including:

a rectangular base for fastening to one of said side or bottom walls of said display;

a compression arm having opposed top and bottom surfaces, said compression arm extending laterally from one side of said base so as to form a slot between said bottom surface and said one side or bottom wall to which said base is fastened; and, a fin extending from an adjacent side of said base in a plane oriented substantially orthogonal to said base and said compression arm, said fin adapted for slidable positioning within the slot formed by the other interconnecting bracket of one said self-locking coupling.

2. A cruciform display, comprising:

a first shelving unit having a first pair of opposed side walls secured together by a first bottom wall;

a second shelving unit having a second pair of opposed side walls, said second pair of opposed side walls being secured together by a top wall and a second bottom wall, said second pair of opposed side walls being oriented in planes positioned substantially parallel to said first pair of opposed side walls, said second bottom wall being centrally positioned atop said first pair of opposed side walls, and said second pair of opposed side walls being more widely spaced from one another than said first pair of opposed side walls;

a third shelving unit having a third pair of opposed side walls secured together by a second top wall, said top wall having substantially the same width as said first bottom wall, said third pair of opposed side walls being centrally positioned atop said second top wall and oriented substantially in the same planes as said first pair of opposed side walls;

a plurality of self-locking couplings for securing said first pair of opposed side walls to said second bottom wall and said third pair of opposed side walls to said top wall, each of said self-locking couplings including a pair of interconnecting brackets, each of said interconnecting brackets including:

a rectangular base for fastening to one of said side or bottom walls of said display;

a compression arm having opposed top and bottom surfaces, said compression arm extending laterally from one side of said base so as to form a slot between said bottom surface and said one side or bottom wall to which said base is fastened; and, a fin extending from an adjacent side of said base in a plane oriented substantially orthogonal to said base and said compression arm, said fin adapted for slidable positioning within the slot formed by the other interconnecting bracket of one said self-locking coupling; and, a pedestal secured beneath said first bottom wall for supporting said first pair of opposed side walls in an upright orientation, said pedestal including:

a rigid sheet having a surface area greater than that of said first bottom wall; and, a plurality of gussets secured to the top of said rigid sheet, one pair of said gussets being spaced from one another so as to receive said first bottom wall of said first shelving unit therebetween and snugly engage said first pair of opposed side walls.

3. A cruciform display, comprising:

a first shelving unit having a first pair of opposed side walls secured together by a first bottom wall, at least one shelf and a first back wall, said shelf being spaced between said first bottom wall and the respective tops of said first pair of opposed side walls;

a second shelving unit having a second pair of opposed side walls secured together by a top wall, a second bottom wall and a second back wall, said second bottom wall being centrally positioned atop said first pair of opposed side walls, said second pair of opposed side walls being oriented in planes positioned substantially parallel to said first pair of opposed side walls, and said second pair of opposed side walls being more widely spaced from one another than said first pair of opposed side walls;

a third shelving unit having a third pair of opposed side walls secured together by a second top wall and a third back wall, said third pair of opposed side walls being centrally positioned atop said second top wall, said second top wall having a width substantially equal to that of said first bottom wall, and said third pair of opposed side walls being oriented substantially in the same planes as said first pair of opposed side walls;

a pedestal secured beneath said first bottom wall for supporting said first pair of opposed side walls, said pedestal including:

a rigid sheet having a surface area greater than that of said first bottom wall;

a pair of gussets secured to the top of said rigid sheet and spaced from one another so as to receive said first bottom wall of said first shelving unit therebetween and snugly engage said first pair of opposed side walls; and, a third gusset secured to the top of said rigid sheet and spaced from said pair of gussets for engaging said first back wall; and, a plurality of self-locking couplings for securing said first pair of opposed side walls to said second bottom wall and said third pair of opposed side walls to said top wall, each of said self-locking couplings including a pair of interconnecting brackets, each of said interconnecting brackets including:

a rectangular base for fastening to one of said side or bottom walls of said display;

a compression arm having opposed top and bottom surfaces, said compression arm extending laterally from one side of said base so as to form a slot between said bottom surface and said one side or bottom wall to which said base is fastened; and, a fin extending from an adjacent side of said base in a plane oriented substantially orthogonal to said base and said compression arm, said fin adapted for slidable positioning within the slot formed by the other interconnecting bracket of one said self-locking coupling.

* * * * *